US006910303B1

(12) United States Patent
Mathofer

(10) Patent No.: US 6,910,303 B1
(45) Date of Patent: Jun. 28, 2005

(54) DEVICE FOR ACTUATING AN ELECTRONIC LOCKING SYSTEM AND/OR A LOCK INTEGRATED IN A DOOR, A FLAP OR THE LIKE, ESPECIALLY IN A MOTOR VEHICLE

(75) Inventor: Reinhold Mathofer, Wülfrath (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/088,836

(22) PCT Filed: Oct. 2, 2000

(86) PCT No.: PCT/EP00/09633

§ 371 (c)(1),
(2), (4) Date: Mar. 21, 2002

(87) PCT Pub. No.: WO01/25575

PCT Pub. Date: Apr. 12, 2001

(30) Foreign Application Priority Data

Oct. 5, 1999 (DE) ..... 199 47 977

(51) Int. Cl.[7] ..... E06B 3/00
(52) U.S. Cl. ..... 49/503
(58) Field of Search ..... 49/502, 503; 16/DIG. 32

(56) References Cited

U.S. PATENT DOCUMENTS 5,654,687 A * 8/1997 LaBonde ..... 340/426.28
6,241,294 B1 * 6/2001 Young et al. ..... 292/336.3
6,530,251 B1 * 3/2003 Dimig ..... 49/503
6,546,674 B1 * 4/2003 Emerling et al. ..... 49/502

FOREIGN PATENT DOCUMENTS

DE 196 33 894 A1 2/1998

* cited by examiner

*Primary Examiner*—Jerry Redman
(74) *Attorney, Agent, or Firm*—Friedrich Kueffner

(57) ABSTRACT

The invention relates to a device for actuating an electronic locking system and/or a lock integrated in a door (40), a flap or the like, especially in a motor vehicle. Said locking system or lock is actuated by a handle (10) mounted on the door outer side (41). Said handle (10) is fixed to the door (40) by means of a support shoulder (11). The fixation can be of a swiveled type. Known door handles are provided with plug-in couplings mounted on the support shoulder (11) of the door handle (10) to contact the electronics mounted in the handle with control electronics. The aim of the invention is to simplify the manufacture of such a device. To this end, an electric coupling element (31) is swivellably mounted on the support shoulder (11). The support (20) on the door carries a swivelably and/or slideably mounted, electric counter coupling element (32). The inventive device allows that the electric coupling elements (31, 32) of the electric plug-in coupling (30) can be coupled into the door opening simultaneously with the insertion of the support shoulder (11) of the door handle (10), namely already in the first assembly stage.

10 Claims, 8 Drawing Sheets

DEVICE FOR ACTUATING AN ELECTRONIC LOCKING SYSTEM AND/OR A LOCK INTEGRATED IN A DOOR, A FLAP OR THE LIKE, ESPECIALLY IN A MOTOR VEHICLE

BACKGROUND OF THE INVENTION

1. Field of the Invention

The invention relates to a device for actuating an electronic locking system and/or a lock integrated in a door, a flat, or the like, especially in a motor vehicle, including a handle arranged on the exterior side of the door has generally two projections which penetrate openings in the door and project from the back side of the door panel. One projection can comprise a bearing for a pivot support of the handle on a bearing block fixedly connected on the back side of the door, wherein the bearing block has complementary counter bearings. This first projection therefore serves as a bearing projection of the handle.

The second projection of the handle serves primarily as a further securing means of the handle on the door. The second projection can also be configured such that, upon actuation of the handle, it cooperates with lock members on the inner side of the door. Accordingly, by means of this working projection a lock can be actuated after actuation of the handle. Mounting of the handle is realized from the exterior side of the door where the bearing projection as well as the working projection are inserted through the respective openings in the door until they are in the prescribed position on the inner side of the door in the area of the bearing block, on the one hand, and in the area of the lock members, on the other hand. In order to achieve this, a certain movement sequence of the handle is required during the mounting movement through the door opening.

2. Description of the Related Art

In a device of the aforementioned kind known from DE 196 33 894 A1, the handle comprises electronic components in the handle interior which are connected by an electrical line with an electrical coupling provided on the end of the bearing projection. In the mounted state of the door handle, the electrical coupling is connected by means of an electrical counter coupling part and an electrical control line connected thereto with an electronic device of the vehicle. In this known door handle, the bearings of the handle on the bearing projection are arranged in immediate vicinity of the electrical coupling part. When mounting the handle according to DE 196 33 894 A1, the electrical coupling part within the bearing projection is inserted into an electrical counter coupling part which is provided on a support already mounted on the door.

The disadvantage of the device of 196 33 894 A1 is that it is relatively complex with regard to manufacturing technology and that special counter coupling parts must be employed.

SUMMARY OF THE INVENTION

It is an object of the present invention to develop a reliable device of the kind mentioned above which avoids the aforementioned disadvantages.

In accordance with the present invention, the electrical coupling part, which is arranged on the bearing projection of the door handle, is arranged pivotably on it and that the electrical counter coupling part, which must be inserted during mounting of the door handle on the door into the electrical coupling part, is also arranged pivotably at least on a frame part of a support provided on the door. Advantageously, the electrical coupling part can be detachably secured in an initial position on the bearing projection at the beginning of mounting of the door handle on the door so that the electrical coupling part cannot pivot away upon insertion into the electrical counter coupling part.

The electrical counter coupling part can have a shaped means which prevents pivoting of the electrical counter coupling part in the initial position of mounting. This could be, for example, a nose which is positioned within the opening area of the electrical counter coupling part.

Advantageously, the present invention can be produced relatively simply with regard to manufacturing technology. In comparison to normal door handles or coupling part arranged thereat only one bearing must be provided on the bearing projection of the door handle. The coupling part can be a commercially available electrical coupling part which must only be expanded by a bearing. Also, the employed counter coupling part can be a commercially available counter coupling part which is only modified.

In the mounted state the present electrical plug-in coupling has the advantage that the electrical coupling parts cannot move relative to one another upon a pivot movement of the handle. Accordingly, no wear of the electrical plug contact can result. Moreover, the present invention enables a simple and simultaneous mounting of the electrical plug-in coupling and the handle on the door.

In an advantageous embodiment of the invention, the electrical counter coupling part is arranged on the support part by means of a pivot lever which is rotatably supported twofold. One of these bearings this is preferably lockable in one position so that in this position only one of the bearings is pivotable. This ensures a simple insertion of the electrical coupling part into the electrical counter coupling part upon mounting of the door handle on the door.

BRIEF DESCRIPTION OF THE DRAWING

Further advantages and measures of the invention result from the dependent claims, the following description, and the drawings. In the drawings the invention is illustrated with one embodiment. It is shown in:

DETAILED DESCRIPTION OF THE INVENTION

Figure 1:
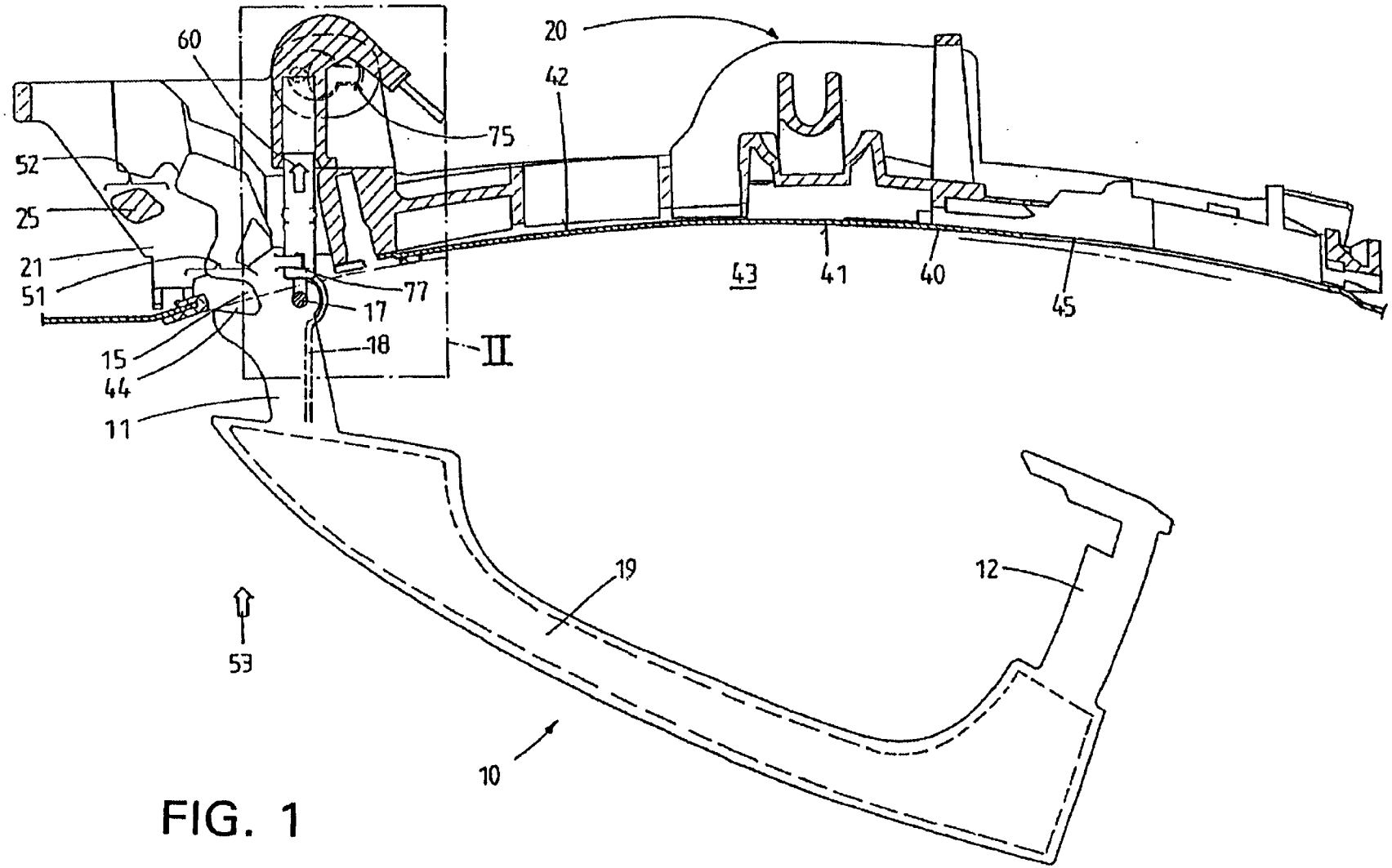
FIG. 1 schematically a longitudinal section of the device fastened on the door of a vehicle, wherein a first mounting position of the handle correlated therewith is illustrated.
Figure 2:
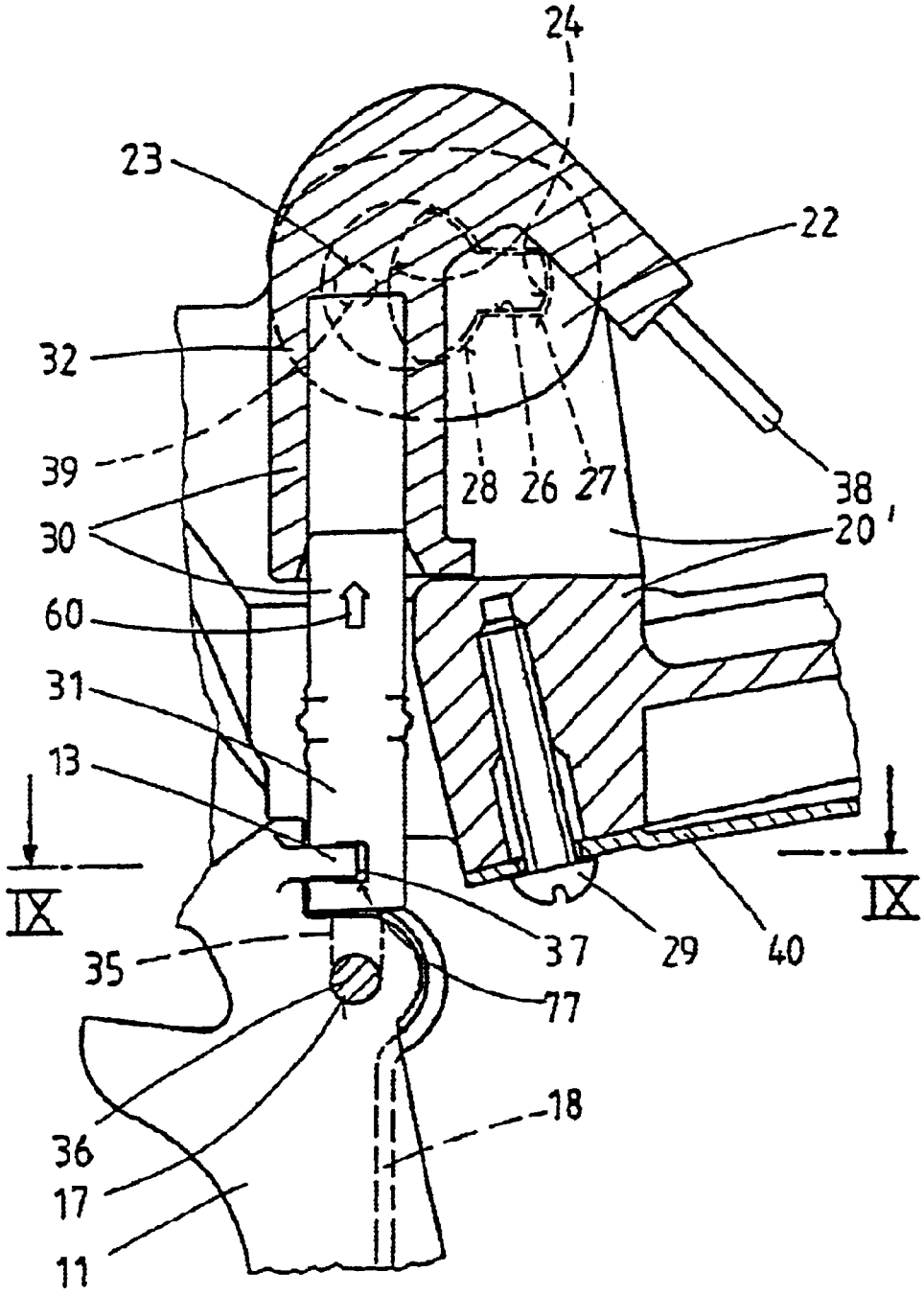
FIG. 2 schematically an enlarged detail of FIG. 1 according to the dash-dotted rectangle II of FIG. 1.
Figure 9:
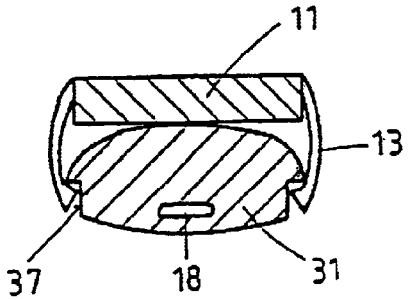
FIG. 9 schematically a section according to the section line IX—IX of FIG. 2.

In FIGS. 1, 2 and 9 the device according to the invention is illustrated in a first mounting position. On the backside 42 of a door 40 a support is mounted which is secured in its position by means of one or more screws 29 on the door panel. In the door 40 several openings 44, 45, 46 are provided which are penetrated, during and after mounting of the door handle 10, by its forward and rearward projections 11, 12.

The door handle 10 has a handle interior 19 in which electronic components are positioned which cooperate with an electronic control device of the locking system or the like. At the leading end of the door handle a projection 11 is formed on the door handle 10 which is embodied as a bearing projection. On this bearing projection 11 a bearing 51 is provided which in the mounted state of the door handle 10 cooperates with a bearing 52 of the support part 20. The support part 20 has for this purpose a bearing block 21 on which the counter bearing 52 is arranged. In the illustrated embodiment, the door handle is pivotably secured on the bearings 51, 52 in the mounted state. An electrical coupling part 31 of an electrical plug-in connection 30 is also arranged on the bearing projection 11. The electrical coupling part 31 is pivotably supported on the bearing projection 11 by means of a pivot bearing 71, which is comprised of a bearing hole 17 provided in the bearing projection 11 and a rotary bearing axle 36 provided on the electrical coupling part 31. The rotary bearing axle 36 is connected by a U-shaped bearing projection 35 with the electrical coupling part 31. The electrical coupling part has moreover an engagement point 37 which can be engaged by securing means 31 of the bearing projection 11. In FIGS. 1, 2 and 9 a first mounting position of the door handle 10 is illustrated in which the electrical coupling part 31 is in this securing position 77.

The electrical coupling part 31 is electrically connected by a connecting line 18 with electronic components in the handle interior 19.

On the support part 22 securing stays 20' are arranged on which the electrical counter coupling part 32 of the electrical plug connection 30 is secured pivotably and slidably.

Figure 8:
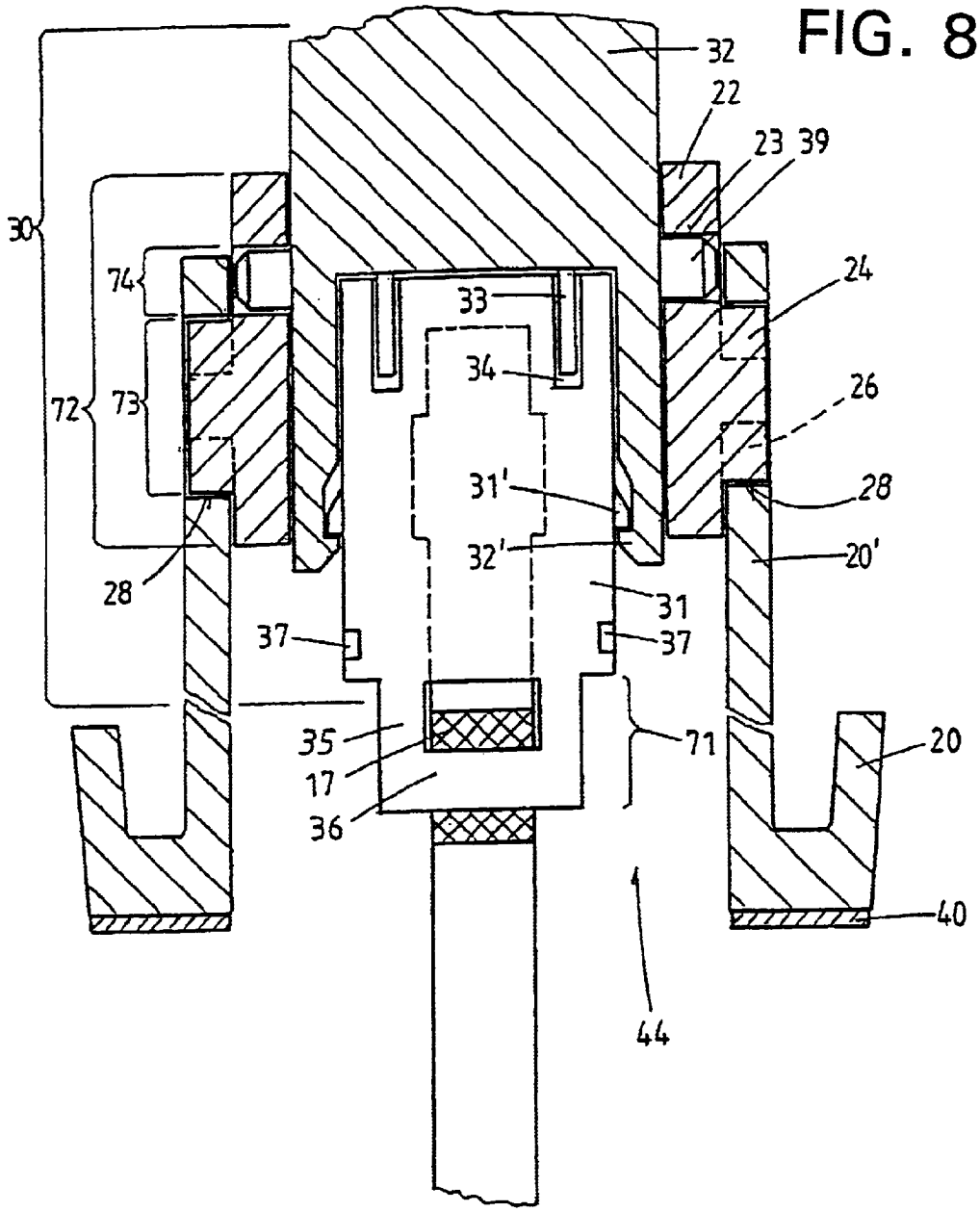
FIG. 8 schematically a section according to the section line VIII—VIII of FIG. 6.

The detailed configuration and the arrangement of the electrical counter coupling part 32 on the securing stay 20' of the support part 20 can be seen in FIGS. 2 and 8. In the area of the door opening 44, through which the bearing projection 11 of the door handle 11 is guided through the door 40, a securing stay 20' as an extension of the support part 20 is formed on the support part 20 on opposed sides of the door opening 44 parallel to the direction of extension of the handle. These securing stays 20' are provided with a bearing eye 28 and a guide slot 27 formed thereon. The bearing eye 28 serves for pivoting a bearing pin 24 on a pivot lever 22. A rearward part of this bearing pin 24 on the pivot lever 22 is formed as a sliding block 26. The bearing pin 24 with the sliding block 26 can have two positions 75 and 76. In the first position of the bearing pin 24, the sliding block 26 is positioned in the guide slot 27 on the securing stay 20'. A pivot movement of the bearing 73 formed of the bearing eye 28 and the bearing pin 24 is not possible. In a second position 76 of the bearing pin 24 in the bearing eye 28, the sliding block 26 is moved out of the guide slot 27 and the bearing pin 24 is positioned entirely within the bearing eye 28 and is rotatable therein. The bearing 73 is now pivotable. On the pivot lever 22 a bearing eye 23 is arranged on its second pivot lever side in which the bearing pin 39 of the electrical counter coupling part 32 is inserted. The bearing pin 39 and the bearing eye 23 from the bearing 74 on which the electrical counter coupling part 32 is pivotably arranged. The bearings 73 and 74 form together a double pivot bearing 72 defined by the pivot lever 22. On the electric counter coupling part 32 a supply and control line 38 is arranged via which the electrical counter coupling member 32 is connected to an electronic control.

Mounting of the device according to the invention is carried out in several movement steps. In FIG. 1 a first movement step of the assembly is illustrated. The door handle 10 is first inserted, corresponding to the direction of the insertion arrow 53, with its bearing projection 11 into the door opening 44 and, in this way, the electrical coupling part 31 is inserted, corresponding to the direction of arrow 60, into the electric counter coupling part 32. The bearing 74 is blocked during this process by the sliding block 26 which is positioned in the guide slot 27.

Figure 3:
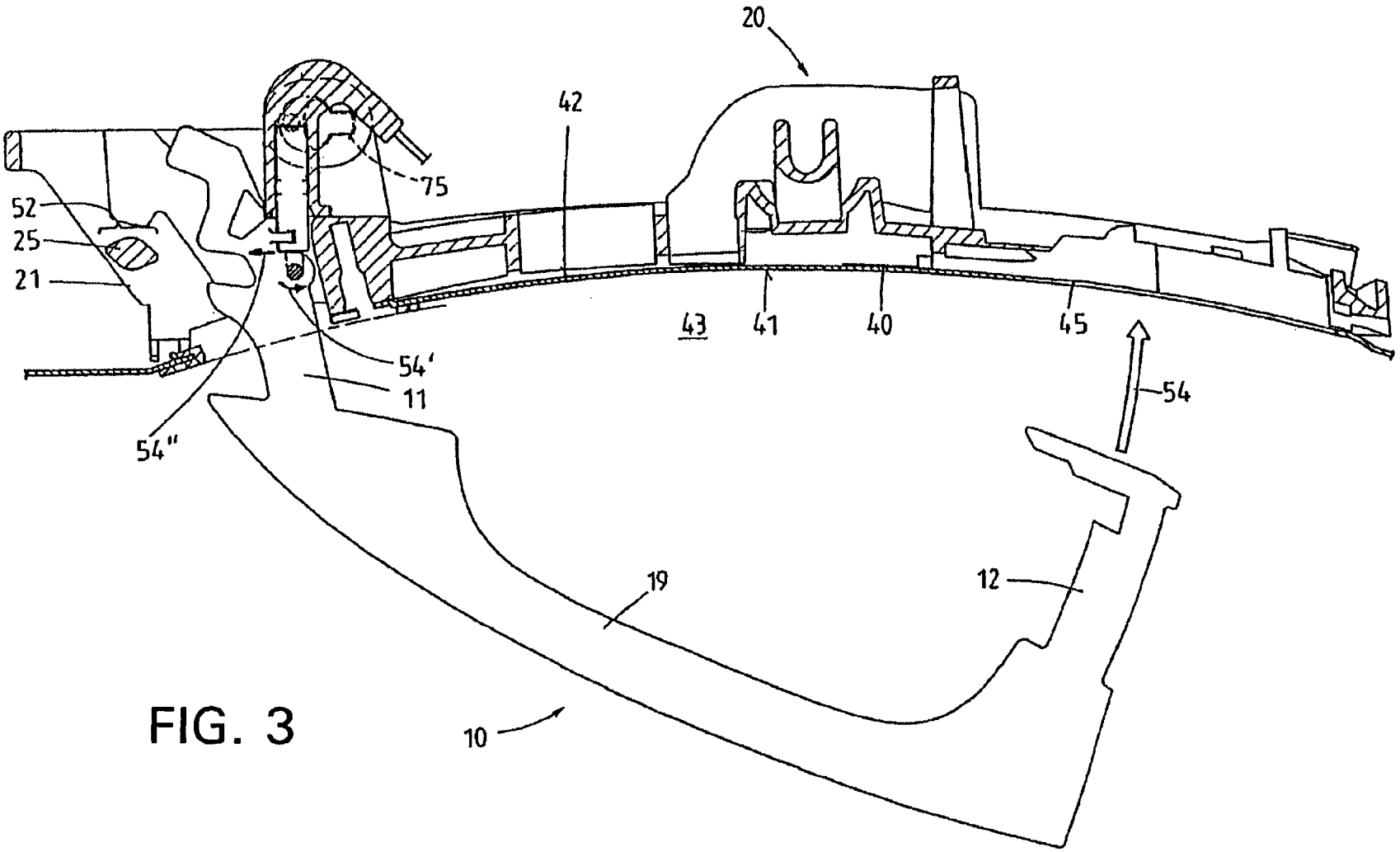
FIG. 3 schematically a longitudinal section corresponding to FIG. 1, with a second mounting position of the device according to the invention illustrated therein.

In FIG. 3 the position reached after this first mounting step is illustrated. The electrical coupling part 31 and the electrical counter coupling 32 form together the electrical plug-in connection 30 in which a contacting is achieved via the pin contacts 33 and the bushing contact 34 which are inserted into one another. The two coupling parts 31 and 32 are secured on one another by coupling means 31' and counter coupling means 32'. This connection is detachable for repair purposes or the like.

FIG. 3 illustrates a further mounting direction of the door handle 10. Corresponding to the illustrated rotational movement in the direction of rotation arrow 54, the projection/working projection 12 of the door handle 10 is pivoted into the door opening 45 of the door 40 from the exterior side 41. In this connection, the bearing 71 is moved in the rotational direction 54', and the securing means 13 is released in the direction of arrow 54" from the engagement point 37 of the electrical coupling part 31. The electrical coupling part 31 and thus the electrical plug-in connection 30 are now in the release position 78.

Figure 4:
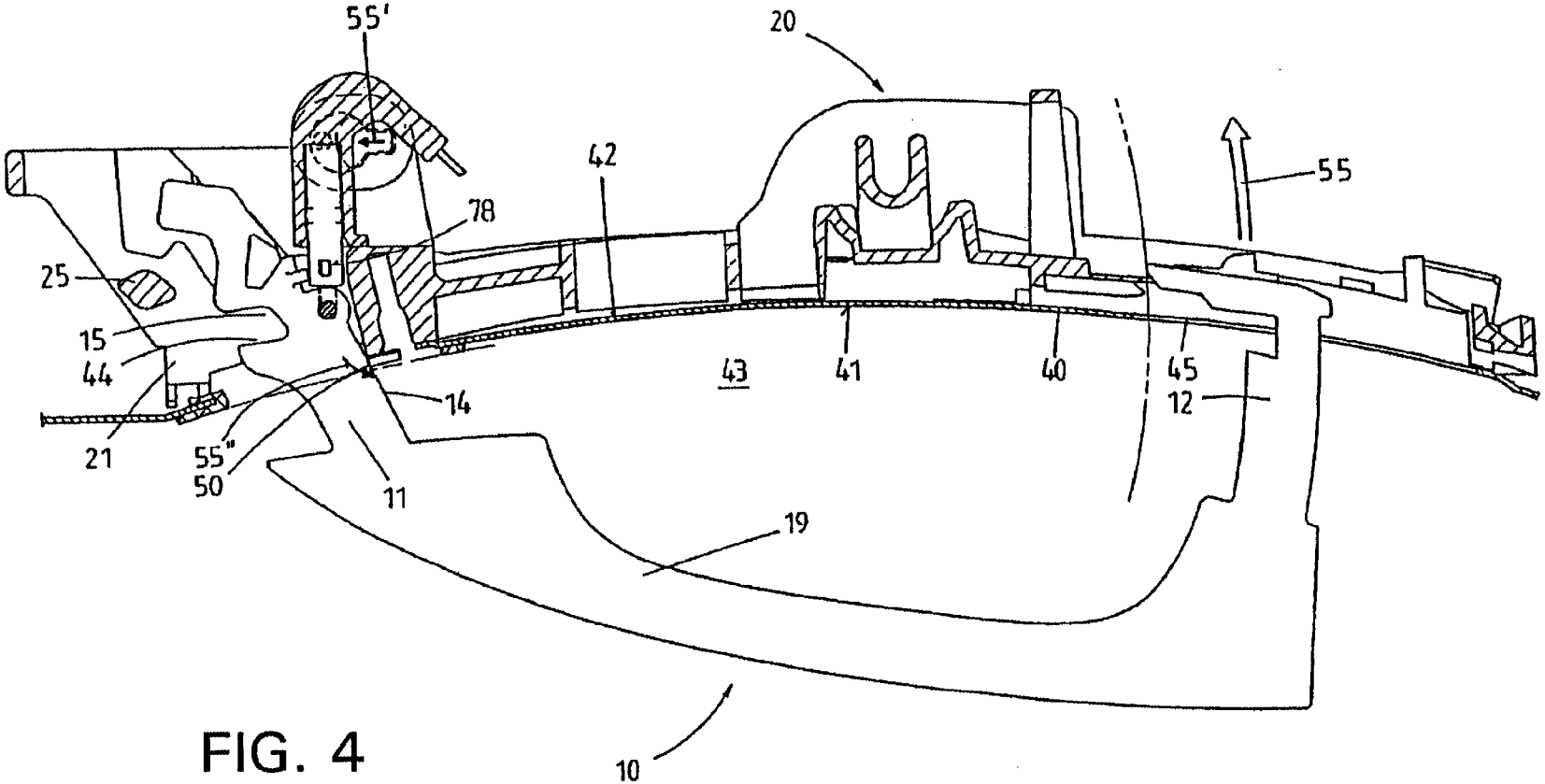
FIG. 4 schematically a section corresponding to FIG. 1 with a third mounting position of the device according to the invention illustrated therein.

At the end of this mounting movement, the leading end of the working projection 10 of the door handle 10 is positioned shortly behind the door opening 45, as illustrated in FIG. 4. Starting from this position, the door handle 10 is further pivoted in the direction of rotation arrow 55. In this connection, the rearward surface 14 of the bearing projection 11 rests against the stop 50 of the support part 20 and becomes the elbow of an elbow lever. The bearing projection 11 is pivoted in this connection in the direction of arrow 55" on the stop 50. As a result of this pivot movement, a lateral movement 55' is exerted onto the bearing pin 24 and its sliding block 26 which thus moves out of the guide slot 27.

Figure 5:
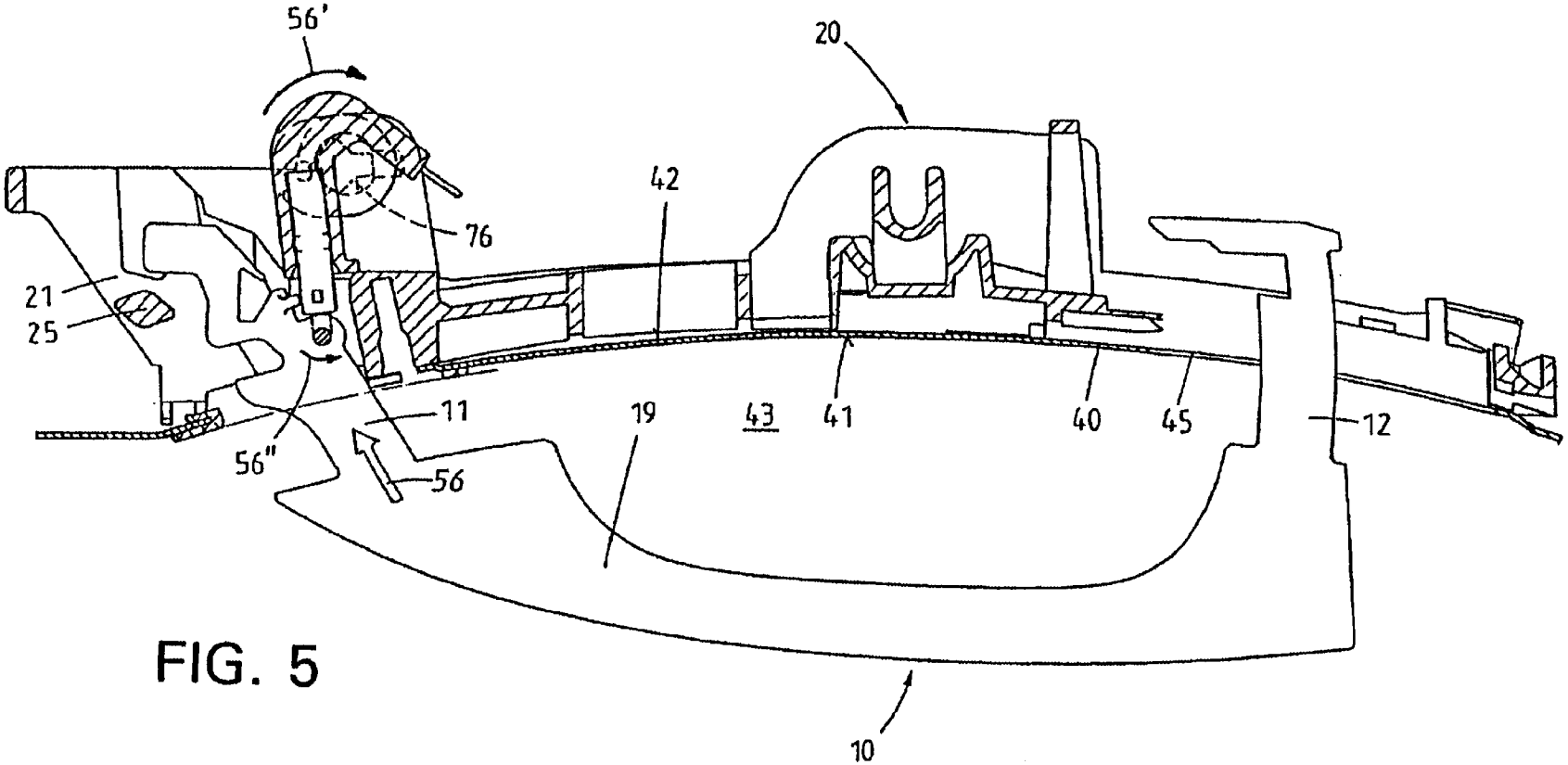
FIG. 5 schematically a longitudinal section corresponding to FIG. 1 with a fourth mounting position of the device according to the invention illustrated therein.

In FIG. 5 the position of the door handle 10 on the door 40 after completion of mounting movement 55 is illustrated. It is shown that the bearing pin 24 is now completely located within the bearing eye 28 and is thus also rotatable. In FIG. 5 moreover the further mounting movement of the door handle 10 is illustrated. Corresponding to arrow 56, the door handle 10 is moved farther into the door. This results in a rotation on the bearing 71 corresponding to the rotational direction 56". The rotation of the bearing 73 is indicated by arrow 56'. Corresponding to the eccentricity of the pivot lever 22, its second bearing with the bearing eye 23 moves upwardly. The bearing 74 compensates the movement of the bearing 73.

Figure 6:
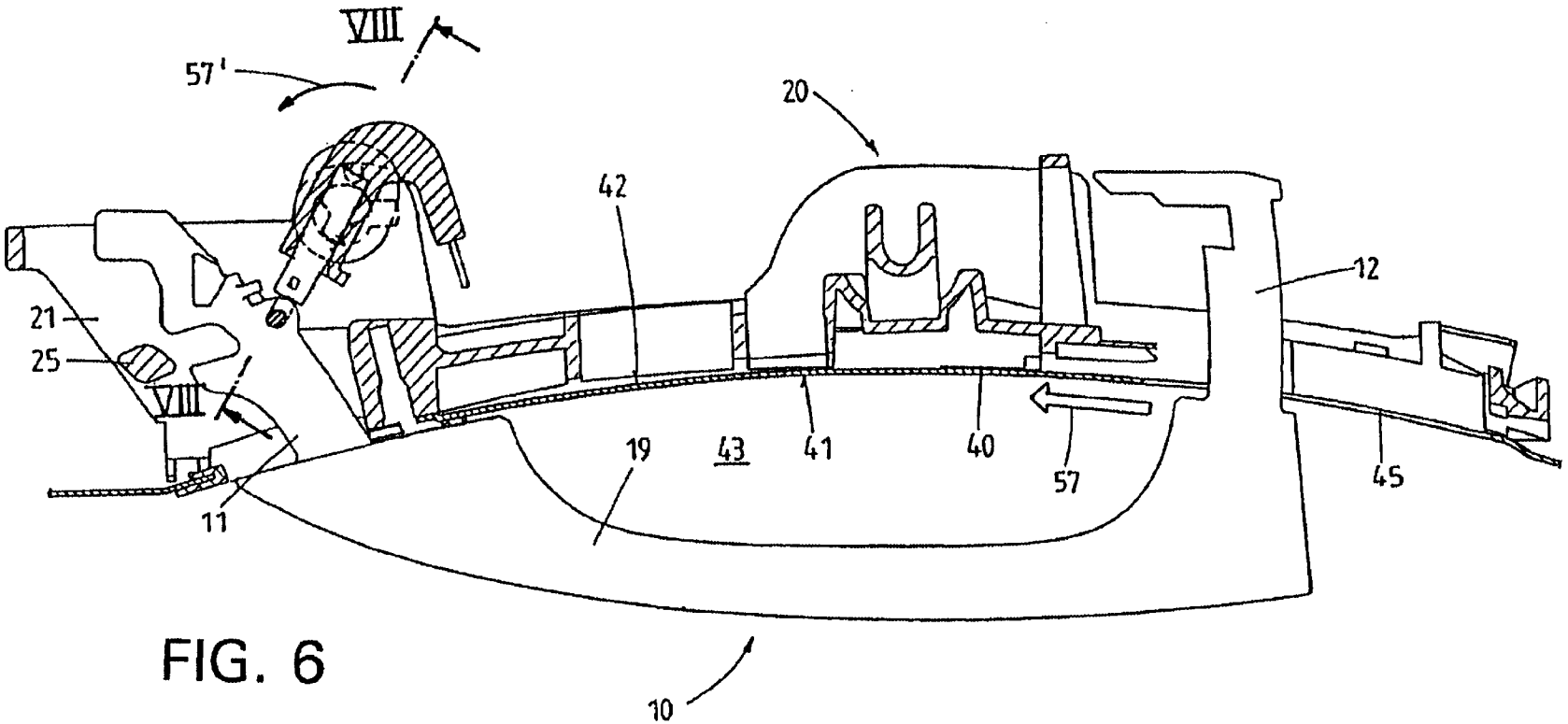
FIG. 6 schematically a longitudinal section corresponding to FIG. 1 with a fifth mounting position of the device according to the invention illustrated therein.
Figure 7:
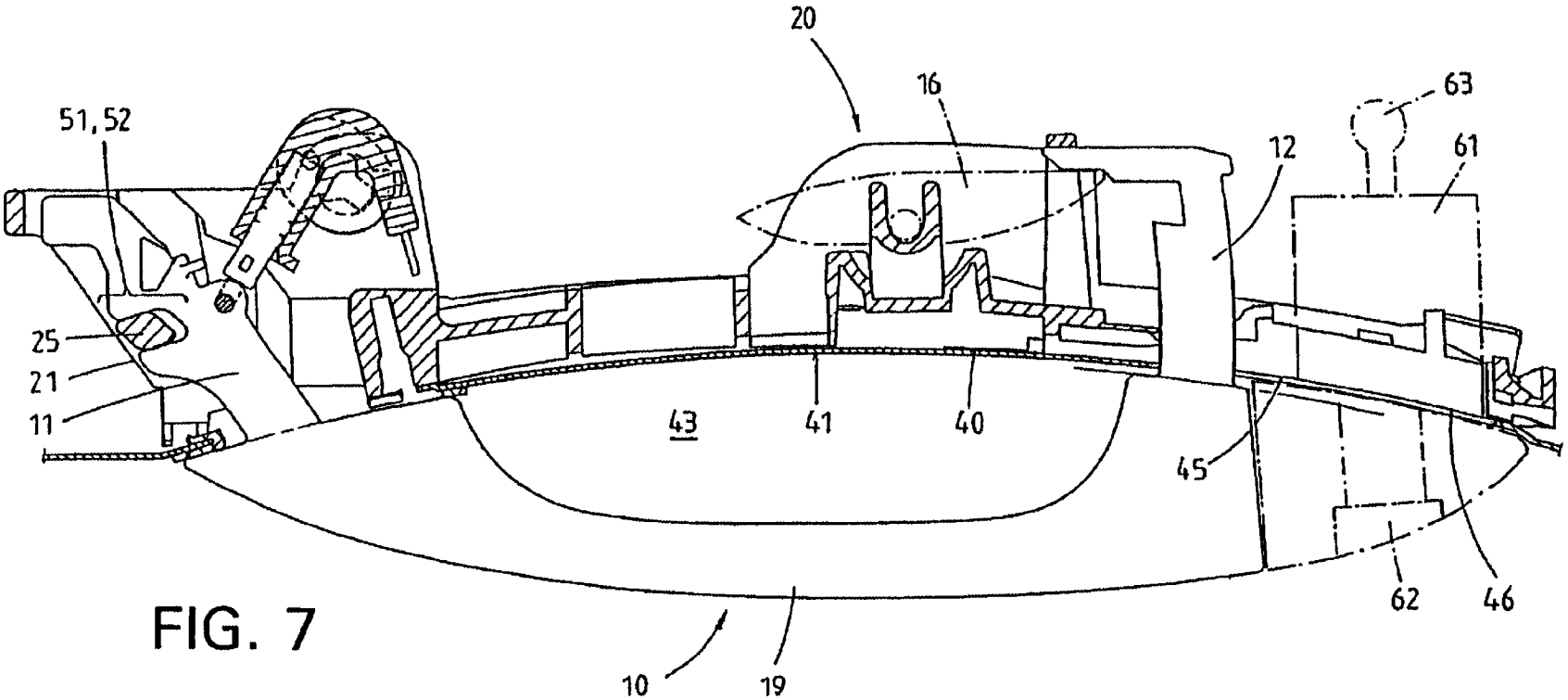
FIG. 7 schematically a longitudinal section corresponding to FIG. 1 with a final mounting position of the device according to the invention illustrated therein.

In FIG. 6 the end position of the mounting movement 56 is illustrated. The handle is now positioned against the door 40.

The door handle 10 is now moved corresponding to the mounting movement 54 along the depression 43 of the door 40 in the direction of arrow 57. This results in a rotation 57' on the bearing 73. Corresponding to the eccentricity of the pivot lever 22, its second bearing with the bearing eye 23 moves again downwardly. The bearings 71, 74 again provide a flowing pivot movement. At the end of this last mounting movement, the bearing eye 15 has moved about the counter bearing 25 and embraces it. The working projection 12 of the door handle 10 moves behind the locking member 16 with which, by means of the door handle 10, a lock can be actuated. For further securing of the door handle 10, the cylinder column 61 and the lock cylinder 62 must be inserted into the door opening 46 so that a return movement of the door handle 10 counter to the mounting movement 57 is no longer possible.

It should be noted in this context that instead of the cylinder column 61 and the lock cylinder 62 also a blind cap can be inserted as is the case, for example, in fully automated locking systems which require no mechanical adjusting movement. By means of the illustrated control member 63 the locking system/lock can be secured or released by means of actuation of the lock cylinder 62.

It should be also noted that the present invention is not limited to the illustrated embodiment. Other embodiments are also conceivable. For example, instead of the double pivot bearing 72 also a guide slot can be provided on the securing stay 20' on which the electrical counter coupling part 32 is directly supported (not illustrated in the drawing).

Also, on the electrical counter coupling part 32 in the direction of the working projection 12 a further nose can be formed which secures the electrical counter coupling part 32 in position during insertion of the electrical coupling part (not illustrated in the drawing).

Instead of the sliding block 26 and the guide slot 27 other means for securing a bearing can also be provided.

LIST OF REFERENCE NUMERALS

10 handle (rest position)
11 projection/bearing projection
12 projection/working projection
13 securing means
14 rearward surface of 11
15 bearing eye of 11
16 locking member (rest position)
17 bearing hole in 11
18 connecting line for 31
19 handle interior of 10
20 support part
20' securing stay of 20
21 stationary bearing block of 20
22 pivot lever
23 bearing eye in 22
24 bearing pin on 22
25 counter bearing to 15
26 sliding block on 22
27 guide slot
28 bearing eye in 20'
29 screw in 20
30 electrical plug-in connection
31 electrical coupling part of 30
31' coupling means
32 electrical counter coupling part of 30 (rest position)
32' counter coupling means
33 pin contact in 32
34 bushing contact in 31
35 U-shaped bearing projection
36 rotary bearing axle of 35
37 engagement point for 13
38 supply and control line for 32
39 bearing pin on 32
40 door, door panel
41 exterior side of 40
42 inner side of 40
43 depression in 40
44 first door opening for 11
45 second door opening for 12
46 third door opening for 61
50 stop
51 bearing on 11
52 counter bearing on 21, 20
53 insertion arrow (mounting movement)
54 rotation arrow (mounting movement)
54' rotational direction bearing 71
54" release movement of 13
55 rotation arrow (mounting movement)
55' retraction movement of 26
55" rotational movement on stop 50
56 arrow (mounting movement)
56' rotational direction, bearing 73
56" rotational direction, bearing 71
57 last pushing movement phase (mounting movement)
57' rotational movement on the bearing 73
60 arrow for insertion direction of 31 into 32
61 cylinder column
62 lock cylinder of 61
63 control member of 62
71 pivot bearing
72 double pivot bearing
73 bearing
74 bearing
75 first position of bearing pin 24
76 second position of bearing pin 24
77 securing position of the electrical coupling part (31)
78 release position of the electrical coupling part (31)

What is claimed is:

1. Device for actuating an electronic locking system or a lock mounted in a vehicle, comprising a handle (10) arranged on an exterior side (41) of a door, which said handle has a projection (11), penetrating an opening (44) in the door (40) and projecting from an inner side (42) of the door and, serving as a bearing projection (11), having bearings (51), and comprising a support part (20) arranged on the inner side (42) of the door which supports a bearing block (21) having counter bearings (52) for the bearings (51) of the handle, and the handle (10) has a handle interior (19) in which electric or electronic means are arranged which are connected by lines (18, 38) and an electric plug-in connection (30) with an electronic control device, wherein one electric coupling part (31) of the electric plug-in connection (30) is arranged on the bearing projection (11) of the handle (10), wherein the handle (10) can be mounted with its bearing projection (11) from the exterior side (41) of the door, wherein the electrical coupling part (31) correlated with the handle (10) is arranged by means of a pivot bearing (71) on the bearing projection (11) of the handle (10), and a counter coupling part (32), correlated with the support part (20) of the electrical plug-in connection (30) is at least one of pivotably and slidably arranged on the support part (20).

2. Device according to claim 1, wherein the counter coupling part (32) correlated with the support part (20) is arranged by means of a pivot bearing (71) on the support part (20).

3. Device according to claim 1, wherein the counter coupling part (32) correlated with the support part (20) is arranged by means of a double pivot bearing (72) on the support part (20).

4. Device according to claim 3, wherein the double pivot bearing (72) is comprised of two bearings (73, 74).

5. Device according to claim 4, wherein the two bearings (73, 74) are coupled with one another by means of a pivot lever (22).

6. Device according to claim 5, wherein in one half of the pivot lever (22) a bearing eye (23) is arranged in which a bearing pin (39) of the counter coupling part (32) is seated and, in this way, a first pivot bearing (74) is formed, and on an oppositely positioned half of the pivot lever (22) on a side facing the support part (20) a bearing pin (24) is provided whose one part is formed as a sliding block (26), and on a securing stay (20') of the support part (20) a bearing eye (28) is arranged into which a guide slot (27) opens from one side, and that in a first position (75) of the bearing pin (24) the sliding block (26) is located in the guide slot (27) and a remaining part of the bearing pin (24) is located in the bearing eye (28), while in a second position (76) the bearing pin (24) with its sliding block (26) is pivotable in the bearing eye (28).

7. Device according to claim 1, wherein the counter coupling part (32) correlated with the support part (20) is arranged by means of a guide slot (27) on the support part (20).

8. Device according to claim 1, wherein on the bearing projection (11) securing means (13) are provided which detachably engage engagement points (37) of the electric coupling part (31).

9. Device according to claim 1, wherein the pivot bearing (71) is comprised of a bearing hole (17) arranged in the bearing projection (11) and a rotary bearing axle (36) arranged on a lower end of the electrical coupling part (31).

10. Device according to claim 1, wherein, in a first securing position (77) of the electrical coupling part (31), securing means (13) engage engagement points (37) of the electrical coupling part (31), while the securing means (13) in a second release position (778) are released from the engagement points (37) of the electrical coupling part (31) with release of the electrical coupling part (31).

* * * * *